United States Patent [19]

Lockett

[11] Patent Number: 4,832,333

[45] Date of Patent: May 23, 1989

[54] NECK EXERCISING DEVICE AND METHOD

[76] Inventor: Ricky P. Lockett, 8030 Ditman St. #100, Philadelphia, Pa. 19136

[21] Appl. No.: 253,668

[22] Filed: Oct. 5, 1988

[51] Int. Cl.[4] ..... A63B 23/02

[52] U.S. Cl. ..... 272/94; 272/139

[58] Field of Search ..... 272/93, 94, 95, 135, 272/136, 139, 126; 273/DIG. 17, 18, 19

[56] References Cited

U.S. PATENT DOCUMENTS

| | | | |
|---|---|---|---|
| Re. 32,547 | 11/1987 | Reed . | |
| 450,188 | 4/1891 | Peterson . | |
| 500,686 | 7/1893 | Corker . | |
| 559,270 | 4/1896 | Edwards . | |
| 745,856 | 12/1903 | Janisch . | |
| 1,517,147 | 11/1924 | Burnett . | |
| 1,530,748 | 3/1925 | Alastalo . | |
| 1,543,346 | 6/1925 | Titus . | |
| 2,049,434 | 8/1936 | Erickson . | |
| 2,051,366 | 8/1936 | Catron . | |
| 2,097,376 | 10/1937 | Marshman | 272/139 |
| 2,357,746 | 9/1944 | Kuss . | |
| 2,475,905 | 7/1949 | Lowry . | |
| 2,633,124 | 3/1953 | Yellin . | |
| 2,701,564 | 2/1955 | Wilhelm . | |
| 2,791,999 | 5/1957 | Bustamante . | |
| 2,855,202 | 10/1958 | Kinne . | |
| 2,958,156 | 11/1960 | Schmahl . | |
| 2,960,793 | 11/1960 | Van Cleare . | |
| 3,124,353 | 3/1964 | Sharkey . | |
| 3,128,095 | 4/1964 | Sharkey . | |
| 3,156,239 | 11/1964 | Uribe . | |
| 3,502,335 | 3/1970 | Sholin . | |
| 3,605,144 | 9/1971 | Hayte . | |
| 3,690,655 | 9/1972 | Chapman . | |
| 3,820,780 | 6/1974 | Tarbox . | |
| 4,066,259 | 1/1978 | Brentham . | |
| 4,111,415 | 9/1978 | Reitano . | |
| 4,168,060 | 9/1979 | Hohenfeldt . | |
| 4,219,193 | 8/1980 | Newman . | |
| 4,221,074 | 9/1980 | Gonzalez . | |
| 4,250,874 | 2/1981 | Rude . | |
| 4,278,249 | 7/1981 | Forrest . | |
| 4,302,005 | 11/1981 | Silberman . | |
| 4,339,124 | 7/1982 | Vogler . | |
| 4,361,324 | 11/1982 | Baroi . | |
| 4,468,023 | 8/1984 | Solloway . | |
| 4,537,393 | 8/1985 | Kusch . | |
| 4,596,387 | 6/1986 | Roberts | 272/93 |
| 4,655,450 | 4/1987 | Rogers . | |

FOREIGN PATENT DOCUMENTS

| | | | |
|---|---|---|---|
| 245274 | 1/1926 | United Kingdom | 272/139 |

*Primary Examiner*—Richard J. Apley
*Assistant Examiner*—John Welsh
*Attorney, Agent, or Firm*—William H. Eilberg

[57] ABSTRACT

A neck exercising device permits the user to exercise all muscles of the neck. The device includes an elongated headband, the headband having a cushioned layer and a support layer. The ends of the headband have fasteners which enable the headband to be secured around the user's head. The headband also includes a plurality of loops, disposed at intervals along the length of the headband. The device further includes an elastic cord, one end of which has a snap hook capable of engaging any of the loops of the headband. The user attaches the snap hook to one of the loops and pulls on the cord while holding the neck in place. After this exercise has been completed, the user can then remove the snap hook from the loop and fasten it to another loop. When the user again pulls on the cord, a different set of neck muscles will be exercised. The headband need not be removed between these steps. The user need only move the snap hook from one loop to another.

7 Claims, 1 Drawing Sheet

NECK EXERCISING DEVICE AND METHOD

BACKGROUND OF THE INVENTION

The present invention relates to the field of exercise devices for developing muscles of the neck. It can also be used to rehabilitate neck muscles which have been injured in accidents or in contact sports.

The neck musculature is an area which is prone to injury, but which is often neglected by medical professionals. The neck can be injured in sports, in automobile accidents, or during ordinary daily acitivities. The injury known as "whiplash" is a common result of even minor automobile accidents. Also, many persons develop "crooks" in their necks as a result of awkward sleeping or resting positions.

The neck region is vulnerable because it must support the equivalent of a 10–15 pound weight from what is, in effect, the end of a lever. That is, the neck muscles must control the movements of the head from one end of the head. It is more difficult to control an object from its end than at its middle, and the same is true in the case of the neck and head. For example, the neck is responsible for maintaining a static position, e.g. preventing the head from falling over while reading. Maintaining a static position requires good muscle strength and endurance. Also, due to various postures used for working, reading, walking, or sleeping, the neck muscles tend to be misused or abused. The neck muscles are easily strained if they are not sufficiently strong.

There are various known devices for strengthening the neck musculature. Many of these devices require cumbersome equipment and/or uncomfortable harnessing for the head.The harnesses are attached to various types of resistance, such as weights or springs.

One example of a neck exerciser of the prior art is given in U.S. Pat. No. 450,188. This patent shows a pair of straps which fit around the back of the user's head, the straps being connected to another pair of straps which pull against the neck muscles. While this device can exercise some of the neck muscles, it is not readily adaptable to the exercising of all such muscles. To exercise a different set of muscles requires that the head straps be removed and re-mounted from a different direction.

Other examples of neck exercisers are shown in U.S. Pat. Nos. 4,302,005, 4,339,124, and 4,361,324. The latter patents use free weights for generating resistance to neck muscle movement. In U.S. Pat. Nos. 4,460,171 and 4,537,393, the resistance is supplied by springs mounted to a wall. U.S. Pat. Nos. 4,250,874 and 4,066,259 disclose exercise devices which use pneumatic cylinders. U.S. Pat. No. 4,278,249 provides friction resistance for exercising the neck.

U.S. Pat. Nos. 4,468,023 and 4,416,451 show neck exercise devices in which water is the form of resistance. Other examples of neck exercising devices are shown in U.S. Pat. Nos. 4,655,450, 2,791,999, and 2,855,202.

The present invention is a neck exercise device which is simple of construction, easy to use, and portable. It does not require complex equipment, and does not need to be used with a wall or other fixed surface. It also is adjustable, so that substantially all the neck muscles can be exercised without removing the device.

SUMMARY OF THE INVENTION

The device of the present invention includes an elongated headband, the ends of the headband having a fastening means which allows the headband to be secured tightly but comfortably around the head. The headband preferably includes two layers, a cushioned layer which contacts the head, and a support layer which provides strength for the headband. The headband also has a plurality of loops, the loops being disposed at intervals along the length of the headband. The device also includes an elastic cord, one end of which is free, the other end terminating in a snap hook. The snap hook can engage any one of the loops.

In practicing the method of the present invention, the user fastens the headband around the head, and then attaches the snap hook to one of the loops. The user pulls on the cord to exercise the neck muscles. The user may pull on the cord while attempting to hold the head in place, or may move the head while holding the hand in place. Other exercises, or combinations of exercises, can also be done. When an exercise is completed, and it is desired to exercise another set of muscles, the user simply removes the hook from the loop and attaches the hook to another loop. There is no need to remove the headband while changing the position of the hook.

The device of the invention is thus very portable, and can be used virtually anywhere. It requires no complex equipment. It permits virtually all of the muscles of the neck to be exercised.

It is therefore an object of the present invention to provide a neck exercise device.

It is another object to provide a neck exercise device which is simple of construction and portable, and which does not require complex auxiliary equipment or fixed surfaces.

It is another object to provide a neck exercise device which can be used to exercise substantially all the muscles of the neck.

It is another object to provide a method of exercising the muscles of the neck.

It is another object to provide a device and method for rehabilitating weakened neck muscles.

It is another object to provide a neck exercise device which is easily adjusted to varying head sizes.

Other objects and advantages of the invention will be apparent to those skilled in the art, from a reading of the following brief description of the drawings, the detailed description of the invention, and the appended claims.

DETAILED DESCRIPTION OF THE INVENTION

Figure 1:
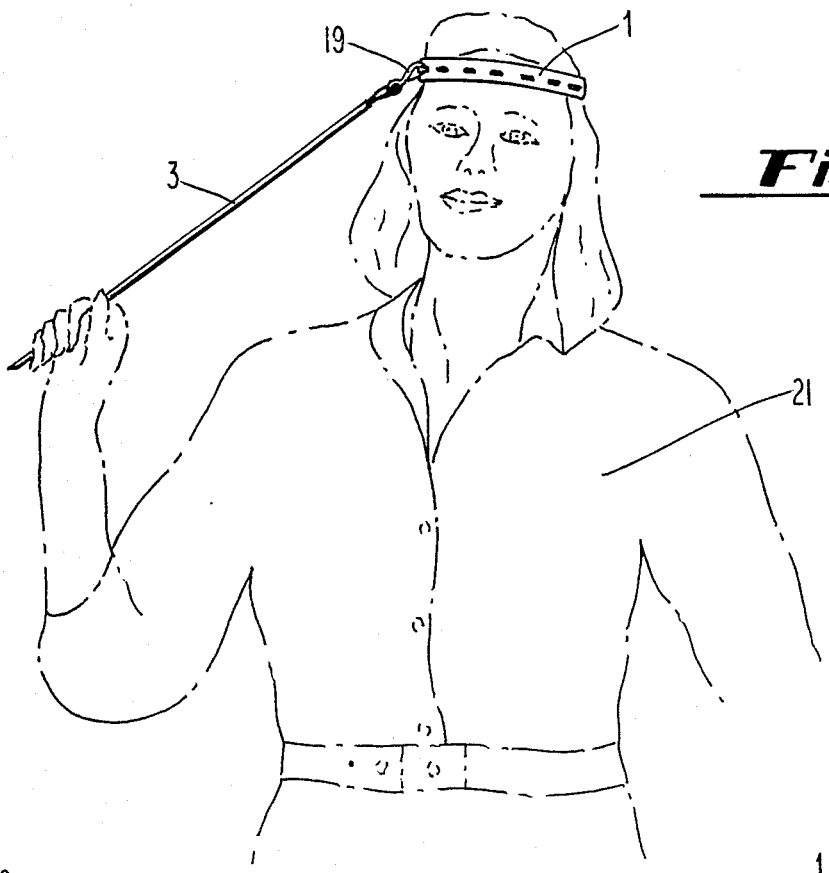
FIG. 1 is a perspective view showing the device of the present invention in use.
Figure 2:
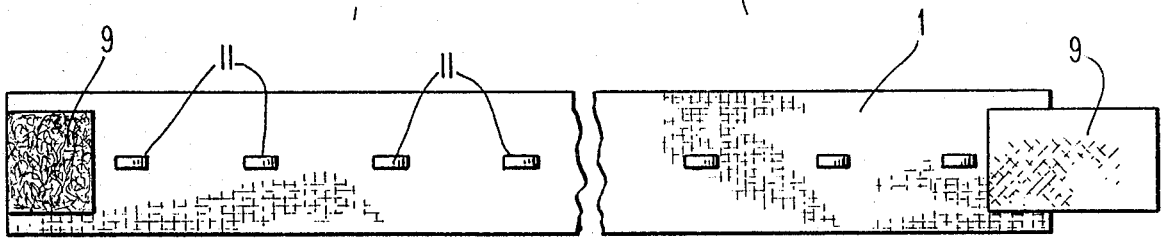
FIG. 2 is a partially fragmentary top view of the headband portion of the device of the invention.
Figure 3:
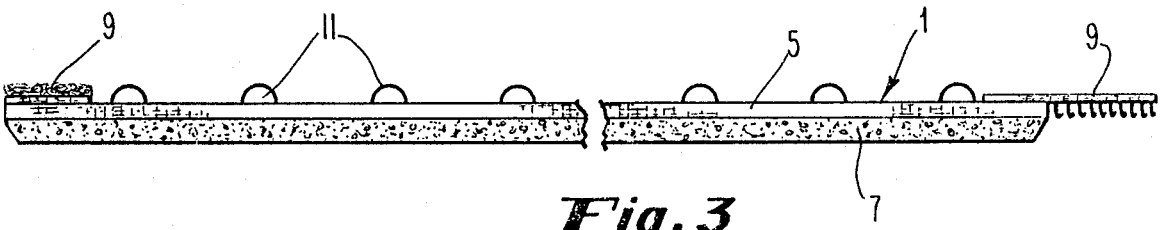
FIG. 3 is a partially fragmentary side view of the headband portion.

The exercise device of the present invention includes headband 1 and elastic cord 3, as shown in FIG. 1. The structure of the headband is shown in more detail in FIGS. 2 and 3. As shown in FIG. 3, the headband includes support layer 5 and cushioned layer 7. The support layer is preferably made of leather, canvas, or other similar material which is capable of providing strength for the headband. The cushioned layer is preferably a foam material, affixed to the support layer by a suitable adhesive or by other means. The cushioned layer is preferably about 0.25 inches thick, but this dimension can be varied, within the scope of the invention. The cushioned layer is intended to contact the head when the device is in use, thereby insuring that the device will not be uncomfortable to the user.

The headband has fasteners 9, attached to both ends. These fasteners are preferably of the type sold under the trademark "Velcro". One of the fasteners extends beyond the end of the hadband, as shown, so that it can engage the fastener at the other end. Thus, the headband can be easily fastened around the user's head such that the headband generally defines a simple closed curve. The Velcro fastener is adjustable, so that the headband can be attached with varying degrees of tightness, and to heads having various sizes. The headband should be fastened to the head with sufficient tightness that it will remain on the head by itself.

Headband 1 also includes a plurality of loops 11. The loops can be made of metal or plastic, or any other suitable material. They are arranged at intervals along the length of the headband. The intervals are preferably uniform, as shown in the figures, but nonuniform intervals may also be used. The number of loops can be varied, but it is preferred that there be at least about eight.

Figure 4:
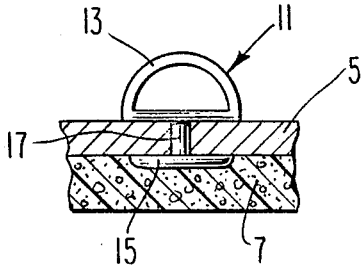
FIG. 4 is fragmentary cross-sectional detail showing the attachment of a loop to the headband.

The structure of a typical loop is shown in FIG. 4. Loop 11 includes ring portion 13, base portion 15, and stem portion 17. The stem portion fits through a hole in support layer 5, the hole being just large enough to accommodate the stem portion. Base portion 15 has a diameter larger than that of the stem portion, so that the loop cannot easily be pulled out of the headband. The components of the loop are preferably integrally formed, though they can be separately formed and suitably joined. The loops can also be constructed in other ways.

Cord 3 has snap hook 19 at one end. The snap hook can be easily attached to any one of the loops, as shown in FIG. 1. The other end of the cord is free, so that it can be grasped by user 21, as shown. The cord can be made of elastic tubing or other elastic material. It is also possible to use a non-elastic cord, but an elastic cord is preferred.

In practicing the method of the invention, the user first attaches the headband around the head, preferably the forehead, such that the cushioned layer contacts the head. The Velcro fasteners form the headband substantially into a simple closed curve, and allow the tightness of the headband to be adjusted. The headband should be sufficiently secure that it does not need other support to remain on the head, but it should not be uncomfortably tight. The user then attaches the snap hook of the elastic cord to one of the loops on the headband. Now the user is ready to begin to do the exercises.

There are various ways to perform the exercises. The first method is called isometric. The user simply pulls on the cord while attempting to hold the neck in place. The neck muscles will counteract the force exerted by the cord, and will eventually develop strength.

In another method, called "isotonic", the user moves the head and neck while the hand that holds the cord remains stationary. In still another method, the user holds the hand stationary while the head is first moved away from, and then slowly returns to, its starting position.

The elastic cord allows the user to maintain control over the intensity, speed and range of movement. The device can resist motion in all directions. Thus, the user can practice flexion, extension, right and left rotation, bending, and various combinations of the foregoing motions.

The exercise device permits force to be directed at the neck muscles from one direction at a time. The cord pulls at only one point on the headband. The more loops on the headband, the greater the variety of neck muscles that can be exercised without removing the headband.

Regardless of the method of exercise chosen, the user, when finished, can remove the snap hook from the loop, and attach the hook to another loop. This operation can be done without removing the headband. When any or all of the exercises described above are repeated with the hook attached to a different loop, a different set of neck muscles will, in general, be exercised. The device is therefore very easily adjustable. If there is a reasonable number of loops spaced along the headband, the device can provide exercise for virtually all the muscles of the neck without removing the headband.

If the number of loops is very small, it may be necessary to change the position of the headband in order to exercise the desired neck muscles. but if there are eight or more loops, such re-positioning is usually unnecessary.

The device of the present invention is very portable and light in weight. Because the cord is pulled by the user's hand, there is no need to use a wall or other fixed surface. Thus, the exercise method can be practiced almost anywhere. The device is also simple of construction, and relatively inexpensive to manufacture.

While the invention has been described with respect to one particular embodiment, it is understood that other variations are possible. The specific structure of the loops and the cord can be varied, as can the materials for, and shape of, the headband. The snap hook on the elastic cord could be replaced by other, equivalent means for engaging the loops. These and other similar modifications should be deemed within the spirit and scope of the following claims.

What is claimed is:

1. A method of exercising the neck, comprising the steps of:

(a) affixing an elongated headband around the head of a user, the headband having a plurality of loops disposed at intervals along the headband, (b) attaching a cord to one of the loops, the attaching being accomplished by securing a hook means disposed at one end of the cord to one of the loops, the other end of the cord being free, (c) pulling on the free end of the cord, (d) detaching the hook means from the loop, and (e) repeating steps (b), (c), and (d) for at least one other loop.

2. The method of claim 1, wherein the pulling step comprises pulling on the free end of the cord while attempting to hold the neck stationary.

3. The method of claim 1, wherein the pulling step includes moving the neck while pulling on the free end of the cord, and while attempting to hold the free end stationary.

4. A method of exercising the neck, comprising the steps of attaching a cord to one of a plurality of loops disposed on a headband fastened around a human user's head, pulling on the cord by the user's hand, removing the cord from the loop, attaching the cord to another of said loops, and pulling on the cord by the user's hand, so as to exercise different sets of muscles of the neck.

5. The method of claim 4, wherein the first attaching step is preceded by the step of affixing the headband to the user's head, the headband having a cushioned layer and a support layer, the headband being affixed such that the cushioned layer contacts the user's head.

6. The method of claim 4, wherein the pulling steps are performed by the user's hand while holding the head stationary.

7. The method of claim 4, wherein the pulling steps are performed by the user's head while holding the hand stationary.

* * * * *